US010273553B2

(12) United States Patent
Katsumata et al.

(10) Patent No.: US 10,273,553 B2
(45) Date of Patent: Apr. 30, 2019

(54) COOLING DEVICE AND MULTI-CHAMBER HEAT TREATMENT DEVICE

(71) Applicants: IHI Corporation, Tokyo (JP); IHI Machinery and Furnace Co., Ltd., Tokyo (JP)

(72) Inventors: Kazuhiko Katsumata, Inuyama (JP); Kaoru Isomoto, Tokyo (JP); Takahiro Nagata, Kamo-gun (JP); Akira Nakayama, Hikari (JP); Yuusuke Shimizu, Gifu (JP); Gen Nishitani, Kakamigahara (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 58 days.

(21) Appl. No.: 15/363,081

(22) Filed: Nov. 29, 2016

(65) Prior Publication Data

US 2017/0073787 A1 Mar. 16, 2017

Related U.S. Application Data

(63) Continuation of application No. PCT/JP2015/069903, filed on Jul. 10, 2015.

(30) Foreign Application Priority Data

Jul. 25, 2014 (JP) ..... 2014-151799

(51) Int. Cl.

| | |
|---|---|
| ***C21D 9/00*** | (2006.01) |
| ***F27D 9/00*** | (2006.01) |
| ***C21D 1/667*** | (2006.01) |

(52) U.S. Cl.

CPC ..... *C21D 9/0062* (2013.01); *F27D 9/00* (2013.01); *C21D 1/667* (2013.01); *F27D 2009/0081* (2013.01); *F27D 2009/0089* (2013.01)

(58) Field of Classification Search

CPC ..... C21D 1/667; C21D 9/0062; F27D 2009/0081; F27D 2009/0089; F27D 9/00

(Continued)

(56) References Cited

U.S. PATENT DOCUMENTS 3,407,099 A * 10/1968 Schell ..... B05B 13/0207 134/199
4,938,460 A * 7/1990 Wechselberger ..... C21D 1/667 266/249

(Continued)

FOREIGN PATENT DOCUMENTS

CN 201183809 Y 1/2009
CN 201793645 U 4/2011

(Continued)

*Primary Examiner* — Jessee R Roe
*Assistant Examiner* — Michael Aboagye
(74) *Attorney, Agent, or Firm* — Rothwell, Figg, Ernst & Manbeck, P.C.

(57) ABSTRACT

A cooling device configured to cool an article to be processed by spraying a coolant includes a cooling chamber configured to accommodate the article to be processed, a header pipe having a connecting pipe protruding from a main body section to which a nozzle is attached and into which the coolant supplied into the main body section is supplied, and disposed in the cooling chamber, and an attachment section formed at the cooling chamber and into which the connecting pipe is inserted from an inside of the cooling chamber to an outside of the cooling chamber.

12 Claims, 7 Drawing Sheets

(58) Field of Classification Search
USPC ..... 266/46, 121, 252, 259
See application file for complete search history.

(56) References Cited

U.S. PATENT DOCUMENTS

| | | | |
|---|---|---|---|
| 2013/0032977 | A1 | 2/2013 | Katsumata et al. |
| 2013/0153547 | A1 | 6/2013 | Katsumata |

FOREIGN PATENT DOCUMENTS

| | | | |
|---|---|---|---|
| CN | 202415634 | U | 9/2012 |
| CN | 203683592 | U | 7/2014 |
| EP | 3 150 730 | A1 | 4/2017 |
| JP | 58-205613 | A | 11/1983 |
| JP | 1-152738 | U | 10/1989 |
| JP | 5-2785 | U | 1/1993 |
| JP | 2003-183740 | A | 7/2003 |
| JP | 2011-196621 | A | 10/2011 |
| JP | 2012-13341 | A | 1/2012 |
| JP | 2014-51695 | A | 3/2014 |
| WO | 2011/129340 | A1 | 10/2011 |

* cited by examiner

COOLING DEVICE AND MULTI-CHAMBER HEAT TREATMENT DEVICE

CROSS-REFERENCE TO RELATED APPLICATIONS

The present application is a continuation application of International Application No. PCT/JP2015/069903, filed Jul. 10, 2015, which claims priority to Japanese Patent Application No. 2014-151799, filed Jul. 25, 2014. The contents of these applications are incorporated herein by reference in their entirety.

TECHNICAL FIELD

The present disclosure relates to a cooling device and a multi-chamber heat treatment device.

BACKGROUND

For example, Patent Document 1 discloses a multi-chamber heat treatment device including three heating devices and one cooling device. In the multi-chamber heat treatment device, the heating devices and the cooling device are connected via an intermediate conveyance chamber, and for example, articles to be processed heated by the heating devices are conveyed into the cooling device and cooled in the cooling device. A header pipe at which nozzles are installed is disposed at the above-mentioned cooling device. In the above-mentioned cooling device, the articles to be processed are cooled by a coolant sprayed from the nozzles through a header pipe (see Patent Document 2). In addition, background art is also disclosed in the following Patent Documents 3 to 5.

DOCUMENTS OF THE RELATED ART

Patent Document

[Patent Document 1]
Japanese Unexamined Patent Application, First Publication No. 2014-051695
[Patent Document 2]
Japanese Unexamined Patent Application, First Publication No. 2011-196621
[Patent Document 3]
Japanese Unexamined Patent Application, First Publication No. 2012-013341
[Patent Document 4]
Japanese Unexamined Utility Model (Registration) Application Publication No. H05-002785
[Patent Document 5]
Japanese Unexamined Patent Application, First Publication No. S58-205613

SUMMARY

Incidentally, the above-mentioned multi-chamber heat treatment device is used for heat treatment of articles to be processed having various shapes. Since appropriate positions of the nozzles or ejection directions of the coolant from the nozzles are varied according to shapes or the like of the articles to be processed, it is preferable for the nozzles to be easily exchangeable. However, in the multi-chamber heat treatment device of the background art, the header pipe cannot be easily removed from the cooling chamber of the cooling device in which the articles to be processed are accommodated, and the nozzles cannot be easily exchanged. For this reason, for example, it is difficult to easily deal with the change of the articles to be processed.

In consideration of the above-mentioned problems, the present disclosure is directed to provide a cooling device and a multi-chamber heat treatment device that are configured to cool articles to be processed by spraying a coolant from nozzles attached to a header pipe, and in which the nozzles can be easily exchanged.

The present disclosure employs the following configuration serving as a means configured to solve the problems.

The present disclosure is a cooling device configured to cool an article to be processed by spraying a coolant, the cooling device including: a cooling chamber configured to accommodate the article to be processed; a header pipe having a connecting pipe protruding from a main body section to which a nozzle is attached and into which the coolant supplied into the main body section is supplied, and disposed in the cooling chamber; and an attachment section formed at the cooling chamber and into which the connecting pipe is inserted from an inside of the cooling chamber toward an outside of the cooling chamber.

According to the present disclosure, the header pipe has the connecting pipe protruding from the main body section to which the nozzles are attached, and the header pipe and the cooling chamber are connected when the connecting pipe is inserted into the attachment section formed at the cooling chamber. According to the above-mentioned present disclosure, as the stopper that is detachably attached to the inner wall of the cooling chamber is removed, the header pipe can be easily attached and detached to and from the attachment section, and exchange of the header pipe, i.e., exchange of the nozzle, can be easily performed. Accordingly, according to the present disclosure, in the cooling device and the multi-chamber heat treatment device that are configured to cool the article to be processed by spraying a coolant from the nozzle attached to the header pipe, the nozzle can be easily exchanged according to the shape or the like of the article to be processed.

DETAILED DESCRIPTION

Hereinafter, an embodiment of a cooling device and a multi-chamber heat treatment device according to the present disclosure will be described with reference to the accompanying drawings. Further, in the following drawings, the scales of components may be appropriately varied to illustrate the components in recognizable sizes.

Figure 1:
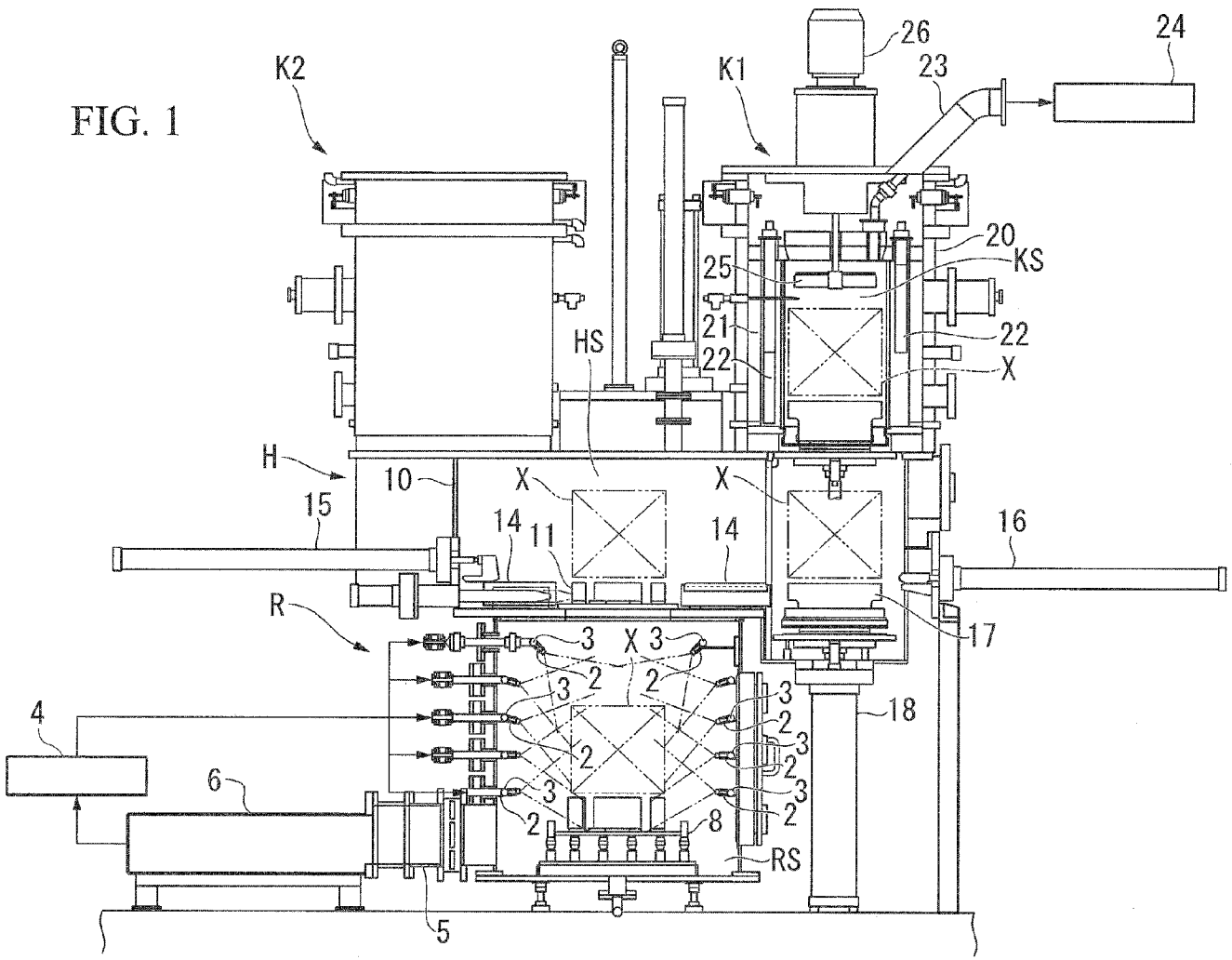
FIG. 1 is a first longitudinal cross-sectional view showing the entire configuration of a cooling device and a multi-chamber heat treatment device according to an embodiment of the present disclosure.

As shown in FIG. 1, a multi-chamber heat treatment device including a cooling device of the embodiment is a device in which a cooling device R, an intermediate conveyance device H, and two heating devices (a heating device K1 and a heating device K2) are combined. Further, the number of heating devices may be 3.

The cooling device R is a device configured to cool an article, to be processed X, and as shown in FIGS. 1 to 6, includes a cooling chamber 1, a plurality of cooling nozzles 2 (nozzles), a plurality of mist headers 3 (header pipes), a cooling pump 4, a cooling drain pipe 5, a cooling water tank 6, a cooling circulation pipe 7, a plurality of agitation nozzles 8, and so on.

The cooling chamber 1 is a container (a container having a central axis disposed in a vertical direction) having a longitudinal cylindrical shape and configured to accommodate the article to be processed X, and an internal space is a cooling region RS. An upper portion of the cooling chamber 1 is connected to the intermediate conveyance device H, and an opening configured to bring the cooling region RS in communication with an internal space (a conveyance region HS) of the intermediate conveyance device H is formed in the cooling chamber 1. The article to be processed X is loaded into the cooling region RS or unloaded from the cooling region RS via the opening. The cooling chamber 1 can store a coolant.

Figure 2:
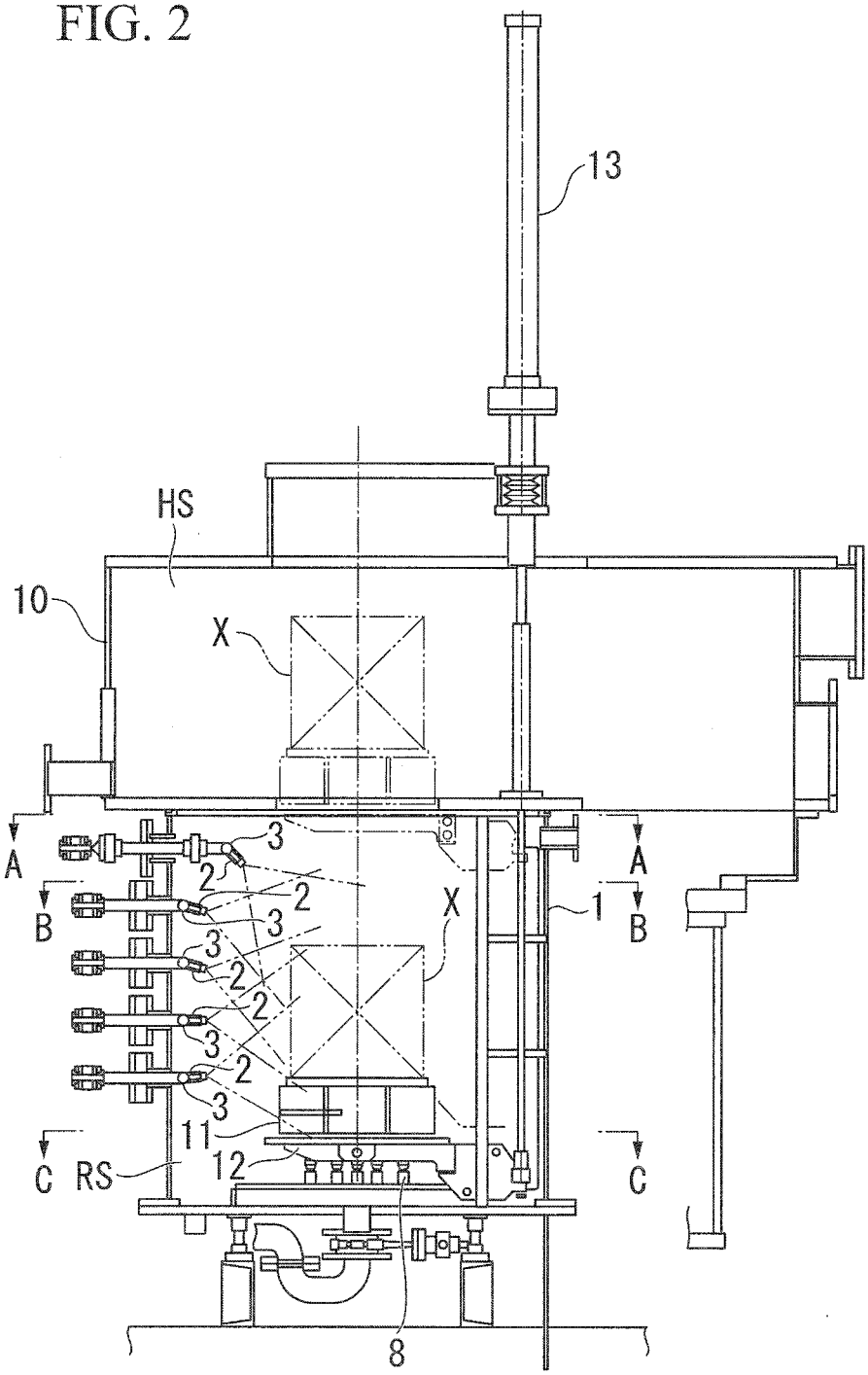
FIG. 2 is a second longitudinal cross-sectional view showing the entire configuration of the cooling device and the multi-chamber heat treatment device of the embodiment of the present disclosure.
Figure 3:
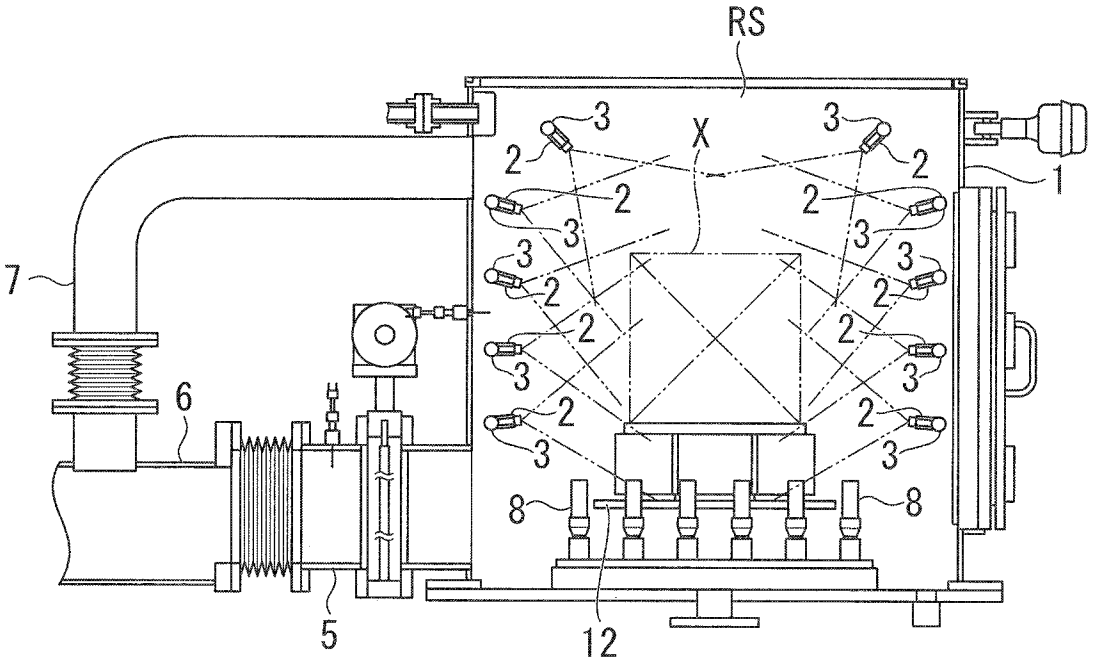
FIG. 3 is a longitudinal cross-sectional view showing the entire configuration of the cooling device according to the embodiment of the present disclosure.

As shown in FIGS. 1 to 3, the plurality of cooling nozzles 2 are disposed to be dispersed around the article to be processed X accommodated in the cooling region RS. More specifically, the plurality of cooling nozzles 2 are disposed to be dispersed such that the cooling nozzles 2 surround the entire article to be processed X and are preferably equidistant from the article to be processed X in a state in which the cooling nozzles 2 are formed in a plurality of stages in a vertical direction (specifically, five stages) around the article to be processed X and in a state in which the cooling nozzles 2 are disposed at certain intervals in a circumferential direction of the cooling chamber 1 (the cooling region RS).

Figure 4:
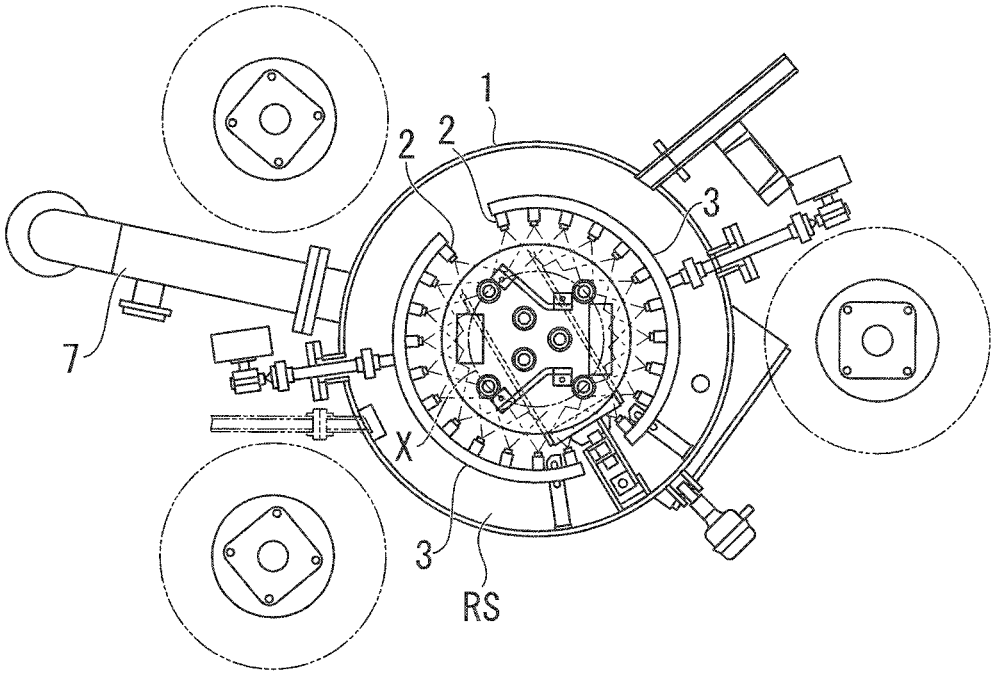
FIG. 4 is a cross-sectional view taken along line A-A of FIG. 2.

In addition, the plurality of cooling nozzles 2 are divided into a predetermined number of groups. That is, the plurality of cooling nozzles 2 are grouped in stages in the vertical direction of the cooling region RS, and also grouped into a plurality of groups in a circumferential direction of the cooling chamber 1 (the cooling region RS). As shown in FIGS. 2 to 4, the mist headers 3 are individually installed at the plurality of groups (nozzle groups).

Figure 5:
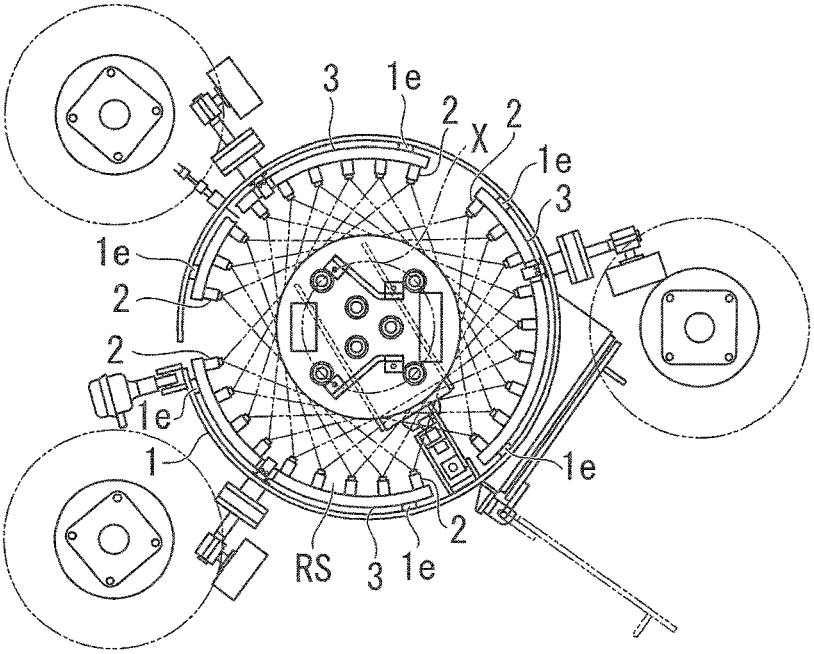
FIG. 5 is a cross-sectional view taken along line B-B of FIG. 2.

More specifically, the plurality of cooling nozzles 2 that belong to the uppermost stage are grouped into two nozzle groups as shown in FIG. 4, and the mist headers 3 are individually installed at the nozzle groups. Meanwhile, the plurality of cooling nozzles 2 that belong to the lowermost stage and three intermediate stages are grouped into three nozzle groups as shown in FIG. 5, and the mist headers 3 are individually installed at the nozzle groups. The cooling nozzles 2 of the above-mentioned nozzle groups are adjusted such that the nozzle shafts are oriented toward the article to be processed X, and the coolant supplied from the cooling pump 4 is sprayed toward the article to be processed X via the mist headers 3.

In addition, as shown in FIG. 1 or 3, the plurality of cooling nozzles 2 that belong to the uppermost stage are disposed at a position higher than that of the upper end of the article to be processed X in the vertical direction. Meanwhile, the plurality of cooling nozzles 2 that belong to the lowermost stage are disposed at a height substantially equal to that of the lower end of the article to be processed X. Further, the plurality of cooling nozzles 2 that belong to the uppermost stage are disposed closer to the central axis of the cooling chamber 1 than the cooling nozzles 2 of the other stages, and disposed to be separated farther from the inner surface of the cooling chamber 1 than the cooling nozzles 2 of the other stages.

Here, the coolant is a liquid having viscosity lower than that of cooling oil generally used for cooling in heat treatment, for example, water. The shape of the ejection holes of the cooling nozzles 2 is set such that a coolant such as water or the like becomes droplets having a uniform and constant particle size at a predetermined spray angle. In addition, the spray angle of the cooling nozzles 2 and the interval between neighboring cooling nozzles 2 are set such that, as shown in FIGS. 1 to 5, in the droplets ejected from the cooling nozzles 2, the droplets disposed at the outer circumferential side cross or collide with droplets disposed at the outer circumferential side ejected from the neighboring cooling nozzles 2.

That is, the plurality of cooling nozzles 2 are configured to spray the coolant toward the article to be processed X such that the article to be processed X is entirely surrounded by aggregates of the droplets of the coolant, i.e., mist of the coolant (coolant mist).

The coolant mist is preferably uniformly formed around the article to be processed X in droplets having a uniform particle size and a uniform concentration. For this reason, the cooling nozzles 2 may be disposed at an appropriate position and angle according to a shape or the like of the article to be processed X.

The cooling device R of the embodiment cools the article to be processed X using the above-mentioned coolant mist, i.e., mist-cools the article to be processed X. Further, cooling conditions such as a cooling temperature, a cooling time, or the like, in the cooling device R are appropriately set according to a purpose of heat treatment of the article to be processed X, a material of the article to be processed X, or the like.

The plurality of mist headers 3 are pipelines in communication with the plurality of cooling nozzles 2, and are installed at each of the above-mentioned nozzle groups. That is, the plurality of mist headers 3 are installed such that a plurality of stages (five stages) are formed upward and downward according to the nozzle groups and a plurality of stages (two or three stages) in the circumferential direction of the cooling chamber 1 (the cooling region RS) to correspond to the nozzle groups.

In addition, as shown in FIG. 4 or 5, a shape of the mist headers 3 is set in an arc shape along the inner surface of the cooling chamber 1 with equal distances between the cooling nozzles 2 and the article to be processed X, and the plurality of cooling nozzles 2 are attached to the mist headers 3 at constant intervals. In the plurality of mist headers 3, pressure drops with respect to the coolant are substantially uniform in the cooling nozzles 2. Accordingly, a substantially uniform amount of coolant is distributed to the cooling nozzles 2.

Figure 7:
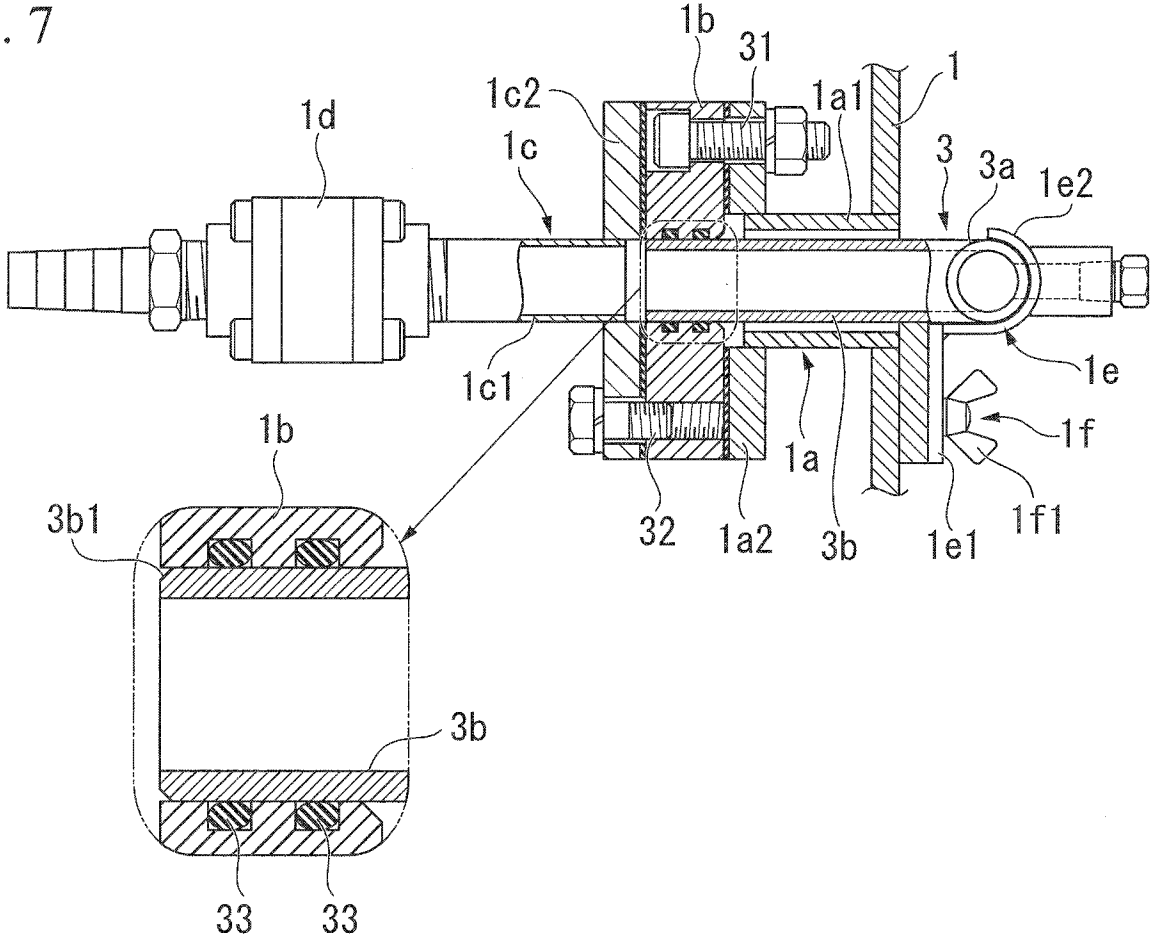
FIG. 7 is an enlarged cross-sectional view including a mist header included in the cooling device and the multi-chamber heat treatment device according to the embodiment of the present disclosure.

Each of the mist headers 3 includes a main body section 3*a* to which the cooling nozzles 2 are attached, and a connecting pipe 3*b* protruding from the main body section 3*a* (see FIG. 7). The main body section 3*a* is a portion curved in an arc shape, and the plurality of cooling nozzles 2 are fixed at equal intervals. The connecting pipe 3*b* is a portion protruding from a side of the main body section 3*a* opposite to the cooling nozzles 2 and into which the coolant supplied into the main body section 3*a* is supplied.

FIG. 7 is an enlarged cross-sectional view including the mist headers 3 installed at the stages other than the uppermost stage. As shown in the drawing, the cooling device R includes an attachment section 1*a* installed at the cooling chamber 1 to correspond to each of the mist headers 3, a seal flange 1*b* fastened to the attachment section 1*a* by a bolt 31, and a coolant supply pipeline 1*c* fastened to the seal flange 1*b* by a bolt 32. In addition, the cooling device R includes an opening/closing valve 1*d* installed in the middle part of the coolant supply pipeline 1*c*, a stopper 1*e* installed at an inner wall of the cooling chamber 1, and a butterfly bolt 1*f* (a thumbscrew) configured to detachably fix the stopper 1*e* to the inner wall of the cooling chamber 1. In addition, the cooling device R includes O-rings 33 (gaskets) interposed between the connecting pipe 3*b* of the mist headers 3 and the seal flange 1*b*.

The attachment section 1*a* is a portion installed as a part of the cooling chamber 1 and to which the connecting pipes 3*b* of the mist headers 3 installed at the stages other than the uppermost stage are attached. The attachment section 1*a* has a pipe section 1*a*1 protruding outward from a container main body of the cooling chamber 1 and into which the connecting pipe 3*b* is inserted, and a flange 1*a*2 installed at a distal end of the pipe section 1*a*1. The pipe section 1*a*1 has a diameter larger than that of the connecting pipe 3*b* of the mist headers 3, and the connecting pipe 3*b* is inserted thereinto from the inside toward the outside of the cooling chamber 1. Further, as shown by an enlarged view of FIG. 7, an edge portion 3*b*1 of a distal end of the connecting pipe 3*b* inserted into the pipe section 1*a*1 is chamfered throughout the circumference.

The seal flange 1*b* is an annular member abutting the flange 1*a*2 and fixed to the flange 1*a*2 by the bolt 31 as described above. Grooves into which the O-rings 33 are fitted are formed at an inner circumferential surface of the seal flange 1*b* throughout the circumference. The grooves are installed in two rows in the axial direction of the connecting pipe 3*b*.

The coolant supply pipeline 1*c* has a pipe section 1*c*1 through which a coolant flows, and a flange 1*c*2 installed at a distal end of the pipe section 1*c*1. The flange 1*c*2 abuts the seal flange 1*b* from a side of the seal flange 1*b* opposite to the flange 1*a*2 of the attachment section 1*a*, and is fixed to the seal flange 1*b* by the bolt 32. Accordingly, the coolant supply pipeline 1*c* is fastened to the seal flange 1*b*. The opening/closing valve 1*d* is installed in the middle part of the pipe section 1*c*1 of the coolant supply pipeline 1*c*. That is, in the embodiment, the opening/closing valve 1*d* is installed at each of the mist headers 3.

Figure 8A:
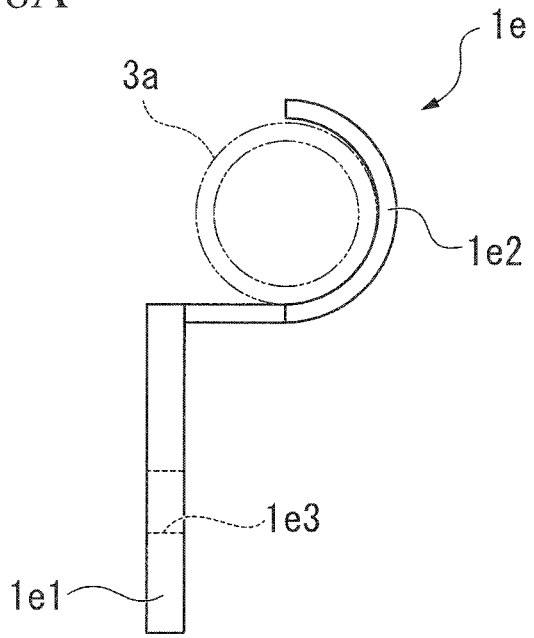
FIG. 8A is a side view serving as a general view of a stopper included in the cooling device and the multi-chamber heat treatment device according to the embodiment of the present disclosure.
Figure 8B:
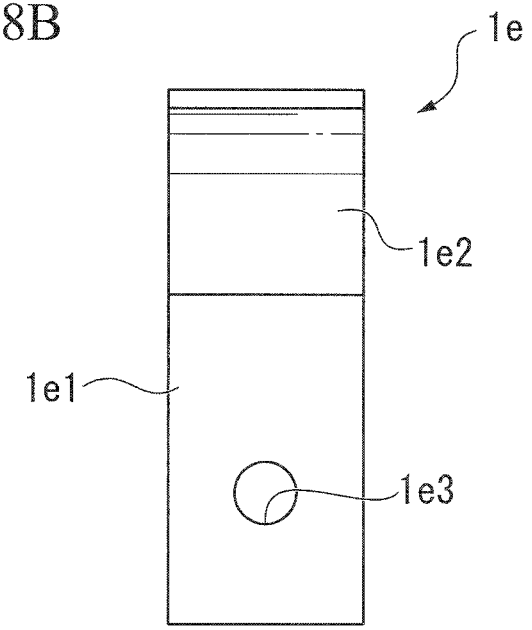
FIG. 8B is a front view serving as a general view of the stopper included in the cooling device and the multi-chamber heat treatment device according to the embodiment of the present disclosure.

FIGS. 8A and 8B are enlarged views of the stopper 1*e*, FIG. 8A is a side view and FIG. 8B is a front view. As shown in FIGS. 8A and 8B, the stopper 1*e* includes a fixing section 1*e*1 having a flat plate shape and fixed to the inner wall of the cooling chamber 1, and a curved section 1*e*2 connected to the distal end of the fixing section 1*e*1 and abutting the main body section 3*a* of the mist header 3. The fixing section 1*e*1 has a through-hole 1*e*3 through which the butterfly bolt 1*f* is inserted. The curved section 1*e*2 is curved to cover the main body section 3*a* of the mist header 3 from the inside of the cooling chamber 1 and have substantially the same curvature as the main body section 3*a*. The stopper 1*e* restricts movement of the mist headers 3 toward the inside of the cooling chamber 1 as the curved section let abuts the main body section 3*a*. For this reason, even when the mist headers 3 are pressed by the coolant supplied from the coolant supply pipeline 1*c* to be moved toward the inside of the cooling chamber 1, positions of the mist headers 3 are restricted by the stoppers 1*e*. In the embodiment, the stoppers 1*e* are installed in the vicinity of both ends of the main body section 3*a* with respect to one of the mist headers 3, i.e., two stoppers 1*e* are installed.

The butterfly bolt 1*f* is a bolt having a blade section 1*f*1 formed at a head section, and fastens the stopper 1*e* to the cooling chamber 1 when the bolt is inserted through the fixing section 1*e*1 of the stopper 1*e* to be threadedly engaged with the cooling chamber 1. The butterfly bolt 1*f* can be detachably attached by an operator without using a tool by pinching and rotating the blade section 1*f*1. That is, as the butterfly bolt if detachably fixes the mist headers 3 to the inner wall of the cooling chamber 1 by detachably fixing the stopper 1*e*.

The O-ring 33 is fitted into a groove formed in the inner circumferential surface of the seal flange 1*b* to be interposed between the connecting pipe 3*b* of the mist headers 3 and the seal flange 1*b*. Two O-rings 33 are arranged in the axial direction of the connecting pipe 3*b* to prevent an internal gas of the cooling chamber 1 from leaking toward the coolant supply pipeline 1*c* side or the like.

Further, in the mist headers 3 of the uppermost stage, the coolant supply pipeline 1*c* to which the connecting pipe 3*b* is connected does not include the flange 1*c*2, and the connecting pipe 3*b* and the pipe section 1*c*1 of the coolant supply pipeline 1*c* are directly connected via a union joint.

Returning to FIG. 1, the cooling pump 4 pumps the coolant remaining in the cooling water tank 6 to the mist headers 3. Here, the cooling device R enables cooling of dipping the article to be processed X in the coolant (dipping cooling), in addition to mist cooling of the article to be processed X using the above-mentioned coolant mist. The dipping cooling can cool the article to be processed X in the cooling chamber 1 using the coolant supplied from the plurality of agitation nozzles 8 in the dipping state. For this reason, a switching valve (not shown) is installed at an ejection port of the cooling pump 4, and the cooling pump 4 alternatively supplies the coolant to the plurality of mist headers 3 or the plurality of agitation nozzles 8. Further, as the cooling pump 4, a cooling pump in which a time variation of the ejection pressure of the coolant is set to a small value is preferably selected.

Figure 6:
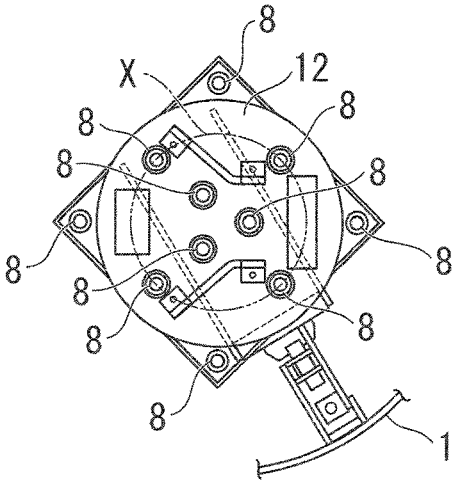
FIG. 6 is a cross-sectional view taken along line C-C of FIG. 2.

The cooling drain pipe 5 is a pipeline configured to bring a lower portion of the cooling chamber 1 in communication with the cooling water tank 6, and a drain valve is installed in the middle part of the pipeline. The cooling water tank 6 is a liquid container configured to store the coolant drained from the cooling chamber 1 via the cooling drain pipe 5 or the cooling circulation pipe 7. As shown in FIG. 3, the cooling circulation pipe 7 is a pipeline configured to bring an upper portion of the cooling chamber 1 in communication with an upper portion of the cooling water tank 6. The cooling circulation pipe 7 is a pipeline configured to return the coolant that overflows from the cooling chamber 1 into the cooling water tank 6 during the above-mentioned dipping cooling. As shown in FIG. 3 or 6, the plurality of agitation nozzles 8 are dispersed and disposed at the lower portion of the cooling chamber 1, and agitate the coolant while supplying the coolant into the cooling chamber 1 by ejecting the coolant upward during the dipping cooling.

The intermediate conveyance device H includes a conveyance chamber 10, a conveyance chamber placing table 11, a cooling chamber elevation table 12, a cooling chamber elevation cylinder 13, a pair of conveyance rails 14, a pair of pusher cylinders (a pusher cylinder 15 and a pusher cylinder 16), a heating chamber elevation table 17, a heating chamber elevation cylinder 18, and so on. The conveyance chamber 10 is a container installed between the cooling device R, the heating device K1 and the heating device K2, and an internal space of the conveyance chamber 10 is the conveyance region HS. The article to be processed X is loaded by an external conveyance apparatus or loaded into the conveyance chamber 10 from an unloading port (not shown) in a state in which the article to be processed X is accommodated in a container such as a basket or the like.

The conveyance chamber placing table 11 is a support frame configured to close a delivery port between the cooling chamber 1 and the conveyance chamber 10 when the article to be processed X is cooled by the cooling device R, and another article to be processed X can be placed thereon. The cooling chamber elevation table 12 is a support frame configured for the article to be processed X to be placed thereon when the article to be processed X is cooled by the cooling device R, and to support the article to be processed X such that a bottom section of the article to be processed X is preferably widely exposed. The cooling chamber elevation table 12 is fixed to a distal end of a movable rod of the cooling chamber elevation cylinder 13.

The cooling chamber elevation cylinder 13 is an actuator configured to vertically move (elevate) the cooling chamber elevation table 12. That is, the cooling chamber elevation cylinder 13 and the cooling chamber elevation table 12 are dedicated conveyance devices of the cooling device R, and convey the article to be processed X placed on the cooling chamber elevation table 12 from the conveyance region HS to the cooling region RS or from the cooling region RS to the conveyance region HS.

The pair of conveyance rails 14 are constructed to extend from a floor section in the conveyance chamber 10 in a horizontal direction. The conveyance rails 14 are guide members when the article to be processed X is conveyed between the cooling device R and the heating device K1. The pusher cylinder 15 is an actuator configured to press the article to be processed X when the article to be processed X in the conveyance chamber 10 is conveyed toward the heating device K1. The pusher cylinder 16 is an actuator configured to press the article to be processed X when the article to be processed X is conveyed from the heating device K1 to the cooling device R.

That is, the pair of conveyance rails 14, the pusher cylinder 15 and the pusher cylinder 16 are dedicated conveyance devices configured to convey the article to be processed X between the heating device K1 and the cooling device R. Further, while the pair of conveyance rails 14, the pusher cylinder 15 and the pusher cylinder 16 are shown in FIG. 1, actually, the intermediate conveyance device H includes the total of two pairs of conveyance rails 14, the pusher cylinder 15, and the pusher cylinder 16. That is, the conveyance rails 14, the pusher cylinder 15, and the pusher cylinder 16 are installed to be used for not only the heating device K1 but also the heating device K2. Further, when a third heating device is installed, the total of two pairs of conveyance rails 14, the pusher cylinder 15, and the pusher cylinder 16 are installed.

The heating chamber elevation table 17 is a support frame on which the article to be processed X is placed when the article to be processed X is conveyed from the intermediate conveyance device H to the heating device K1. That is, the article to be processed X is conveyed immediately onto the heating chamber elevation table 17 when the article to be processed X is pressed by the pusher cylinder 15 to the rightward in FIG. 1. The heating chamber elevation cylinder 18 is an actuator configured to vertically move (elevate) the article to be processed X on the heating chamber elevation table 17. That is, the heating chamber elevation table 17 and the heating chamber elevation cylinder 18 are dedicated conveyance devices of the heating device K1, and convey the article to be processed X placed on the heating chamber elevation table 17 from the conveyance region HS to the inside (a heating region KS) of the heating device K1 or from the heating region KS to the conveyance region HS.

Since the heating device K1 and the heating device K2 basically have the same configuration, in the following description, a configuration of the heating device K1 will be representatively described. The heating device K1 includes a heating chamber 20, an insulation container 21, a plurality of heaters 22, a vacuum exhaust pipe 23, a vacuum pump 24, an agitation blade 25, an agitation motor 26, and so on.

The heating chamber 20 is a container installed on the conveyance chamber 10, and an internal space of the heating chamber 20 is the heating region KS. While the heating chamber 20 is a longitudinal cylindrical container (a container having a central axis in the vertical direction) like the above-mentioned cooling chamber 1, the heating chamber 20 has a size smaller than that of the cooling chamber 1. The insulation container 21 is a longitudinal cylindrical container installed in the heating chamber 20 and formed of an insulation material having predetermined insulation performance.

The plurality of heaters 22 are rod-shaped heat generating bodies, and are formed at predetermined intervals inside in the insulation container 21 and in the circumferential direction in a vertical posture. The plurality of heaters 22 heat the article to be processed X accommodated in the heating region KS to a predetermined temperature (a heating temperature). Further, heating conditions such as a heating temperature, a heating time, or the like, are appropriately set according to a purpose of the heat treatment of the article to be processed X, a material of the article to be processed X, or the like.

Here, a vacuum level (a pressure) in the heating region KS (the heating chamber 20) is included among the heating conditions. The vacuum exhaust pipe 23 is a pipeline in communication with the heating region KS, and has one end connected to an upper portion of the insulation container 21 and the other end connected to the vacuum pump 24. The vacuum pump 24 is an exhaust pump configured to suction air in the heating region KS via the vacuum exhaust pipe 23. The vacuum level in the heating region KS is determined according to an air exhaust amount by the vacuum pump 24.

The agitation blade 25 is a rotary blade formed at an upper portion in the insulation container 21 in a posture in which a direction of the rotary shaft is the vertical direction (upward and downward). The agitation blade 25 is driven by the agitation motor 26 to agitate the air in the heating region KS. The agitation motor 26 is a rotary drive source installed on the heating chamber 20 such that the output shaft is disposed in the vertical direction (upward and downward).

The output shaft of the agitation motor 26 disposed on the heating chamber 20 is coupled to the rotary shaft of the agitation blade 25 disposed in the heating chamber 20 such that airtightness (sealability) of the heating chamber 20 is not damaged.

Further, a multi-chamber heat treatment device according to the embodiment includes a control panel (a control device), which is not shown. The control panel includes a manipulation section configured to allow a user to set various conditions of heat treatment, and a control unit configured to perform heat treatment according to information related to various conditions set and input as described above with respect to the article to be processed X by controlling various drive units such as the cooling pump 4, the heaters 22, the various cylinders, the vacuum pump 24, and so on, based on a control program previously stored therein.

Next, an operation of the multi-chamber heat treatment device configured as above, in particular, an operation of the cooling device R, will be described in detail. The operation of the multi-chamber heat treatment device is independently performed on the basis of information set by the control panel. Further, as is well known, various kinds of heat treatment are provided according to purposes. Hereinafter, an operation of the case in which the article to be processed X is quenched as an example of the heat treatment will be described.

The quenching is terminated by, for example, rapidly cooling the article to be processed X to a temperature T2 after heating to a temperature T1, and slowly cooling the article to be processed X after holding the temperature T2 for a constant time. For example, the article to be processed X accommodated in the intermediate conveyance device H from a loading or unloading port by an external conveyance apparatus is conveyed onto the heating chamber elevation table 17 as the pusher cylinder 15 is operated, and further, is accommodated in the heating region KS as the heating chamber elevation cylinder 18 is operated.

Then, when the article to be processed X is heated to the temperature T1 as the heaters 22 are energized for a certain time, the article to be processed X is conveyed onto the cooling chamber elevation table 12 by operating the heating chamber elevation cylinder 18 and the pusher cylinder 16, and further conveyed into the cooling region RS by operating the cooling chamber elevation cylinder 13.

Here, as the cooling pump 4 is operated and the ejection port of the cooling pump 4 is also connected to the mist headers 3 from the cooling circulation pipe 7, droplets of the coolant are ejected from the cooling nozzles 2 to the article to be processed X. Accordingly, the article to be processed X is mist-cooled by the droplets of the coolant ejected from the cooling nozzles 2.

In addition, as the cooling pump 4 is previously operated to supply the coolant from the plurality of agitation nozzles 8, when the inside of the cooling region RS is filled with the coolant, the article to be processed X can be dipped and cooled. Here, the coolant that overflows from the cooling region RS is returned into the cooling water tank 6 via the cooling circulation pipe 7. Then, when the above-mentioned dipping cooling is terminated, the drain valve is opened and the coolant in the cooling region RS is drained into the cooling water tank 6 via the cooling drain pipe 5 for a short time. Accordingly, the state of the article to be processed X is changed from the state in which it is dipped in the coolant to the state in which it is left in the air for a short time.

According to the multi-chamber heat treatment device including the cooling device R of the above-mentioned embodiment, the mist headers 3 have the connecting pipe 3*b* protruding from the main body section 3*a* to which the cooling nozzles 2 are attached, and the connecting pipe 3*b* is inserted into the attachment section 1*a* installed at the cooling chamber 1. Accordingly, the mist headers 3 and the cooling chamber 1 are connected to each other. In the multi-chamber heat treatment device including the above-mentioned cooling device R, when the stopper 1*e* detachably attached to the inner wall of the cooling chamber 1 is removed therefrom, the mist headers 3 can be easily attached and detached to and from the attachment section 1*a*. Accordingly, exchange of the mist headers 3, i.e., exchange of the cooling nozzles 2, can be easily performed. As a result, according to the multi-chamber heat treatment device including the cooling device R, the cooling nozzles 2 can be easily exchanged according to a shape or the like of the article to be processed X.

In addition, in the multi-chamber heat treatment device including the cooling device R of the embodiment, movement of the mist headers 3 is restricted by the stopper 1*e*. For this reason, the mist headers 3 can be prevented from falling out of the attachment section 1*a*.

In addition, in the multi-chamber heat treatment device including the cooling device R of the embodiment, the edge portion 3*b* 1 of the distal end of the connecting pipe 3*b* is chamfered. For this reason, when the mist headers 3 are inserted into the pipe section 1*a*1 of the attachment section 1*a*, the edge portion 3*b* 1 of the connecting pipe 3*b* can be suppressed from being caught by the pipe section 1*a*1, and attachment of the mist headers 3 to the attachment section 1*a* can be easily performed.

In addition, in the multi-chamber heat treatment device including the cooling device R of the embodiment, the O-rings 33 interposed between the connecting pipe 3*b* of the mist header 3 and the seal flange 1*b* are provided. For this reason, an internal gas of the cooling chamber 1 can be prevented from leaking to the coolant supply pipeline 1*c* side or the like.

In addition, in the multi-chamber heat treatment device including the cooling device R of the embodiment, the butterfly bolt 1*f* configured to fasten the stopper 1*e* to the cooling chamber 1 is provided. For this reason, as attachment of the stopper 1*e* to the cooling chamber 1 and detachment of the stopper 1*e* from the cooling chamber 1 can be easily performed by an operator, exchange work of the mist headers 3 can be easily performed.

In addition, in the multi-chamber heat treatment device including the cooling device R of the embodiment, the opening/closing valve 1*d* is installed at each of the mist headers 3 (i.e., each of the connecting pipes 3*b*). For this reason, in comparison with the case in which one opening/closing valve is used for all of the mist headers 3, the opening/closing valves 1*d* can be installed adjacent to the mist headers 3. For this reason, when the opening/closing valve 1*d* in the closed state is opened, a time until water passes through the mist headers 3 can be reduced. In addition, when opening/closing valve 1*d* in the opened state is closed, a time until water is stopped can also be reduced. As a result, according to the multi-chamber heat treatment device including the cooling device R of the embodiment, responsiveness to a control instruction when the coolant is sprayed can be improved.

While an appropriate embodiment has been described above with reference to the accompanying drawings, the present disclosure is not limited to the embodiment. Shapes, combinations, or the like of the components shown in the above-mentioned embodiment are exemplarily provided, and may be variously varied based on design changes without departing from the spirit of the present disclosure.

For example, while the multi-chamber heat treatment device including the cooling device R, the intermediate conveyance device H, and the two heating devices has been described in the embodiment, the present disclosure is not limited thereto. The cooling device and the multi-chamber heat treatment device according to the present disclosure can also be applied to, for example, a multi-chamber heat treatment device of a type in which the cooling device R and a single heating chamber are adjacent to each other via an opening/closing door.

In addition, while the cooling device R of the embodiment accommodates the article to be processed X in the cooling region RS from above, the present disclosure is not limited thereto. For example, the cooling device and the multi-chamber heat treatment device according to the present disclosure can accommodate the article to be processed X in the cooling region RS from a side (in a horizontal direction) or from below.

In addition, while only one connecting pipe 3*b* is installed at each of the mist headers 3 in the embodiment, the present disclosure is not limited thereto. In the cooling device and the multi-chamber heat treatment device according to the present disclosure, for example, two or more connecting pipes 3*b* may also be installed at each of the mist headers 3.

In addition, while the configuration in which the stopper 1*e* includes the curved section 1*e*2 has been described in the embodiment, the present disclosure is not limited thereto. For example, a bent section may be provided instead of the curved section 1*e*2. In addition, for example, another thumbscrew may be used instead of the butterfly bolt 1*f*.

INDUSTRIAL APPLICABILITY

According to the present disclosure, in the cooling device and the multi-chamber heat treatment device that are configured to cool the article to be processed by spraying the coolant from the nozzle attached to the header pipe, the nozzle can be easily exchanged according to a shape or the like of the article to be processed.

What is claimed is:

1. A cooling device configured to cool an article to be processed by spraying a coolant, the cooling device comprising:

a cooling chamber configured to accommodate the article to be processed, wherein the cooling chamber includes a container main body and an attachment section; and a header pipe having a connecting pipe protruding from a main body section of the header pipe to which a nozzle is attached and into which the coolant supplied into the main body section is supplied, and disposed in the cooling chamber;

wherein the attachment section is part of the container main body of the cooling chamber and comprises a pipe section protruding from an inner surface of the container main body, wherein the attachment section comprises a flange located at an interior distal end of the pipe section, and wherein the connecting pipe is inserted into the pipe section from an inside of the cooling chamber toward an outside of the cooling chamber and supported by the flange.

2. The cooling device according to claim 1, further comprising a stopper detachably fixed to an inner wall of the cooling chamber and configured to restrict movement of the header pipe toward the inside of the cooling chamber.

3. The cooling device according to claim 1, wherein an edge portion of a distal end of the connecting pipe is chamfered.

4. The cooling device according to claim 1, wherein a gasket is interposed between a circumferential surface of the connecting pipe and the attachment section.

5. The cooling device according to claim 1, further comprising a plurality of header pipes, wherein an opening/closing valve is installed at each of the connecting pipes of the header pipes.

6. A multi-chamber heat treatment device comprising:

a heating device configured to heat an article to be processed; and the cooling device according to claim 1.

7. A multi-chamber heat treatment device comprising:

a heating device configured to heat an article to be processed; and the cooling device according to claim 2.

8. A multi-chamber heat treatment device comprising:

a heating device configured to heat an article to be processed; and the cooling device according to claim 3.

9. A multi-chamber heat treatment device comprising:

a heating device configured to heat an article to be processed; and the cooling device according to claim 4.

10. A multi-chamber heat treatment device comprising:

a heating device configured to heat an article to be processed; and the cooling device according to claim 5.

11. The cooling device according to claim 2, wherein the stopper includes a fixing section having a flat plate shape and fixed to the inner wall of the cooling chamber, and a curved section connected to a distal end of the fixing section and abutting the main body section of the header pipe.

12. The cooling device according to claim 1, wherein the pipe section projects away from the container main body of the cooling chamber towards a center region of the cooling chamber.

* * * * *